US005265306A

United States Patent [19]

Yu

[11] Patent Number: 5,265,306

[45] Date of Patent: Nov. 30, 1993

[54] AUTOMATIC DOOR CLOSING DEVICE

[76] Inventor: King-Sung Yu, No. 5, Alley 31, Lane 556, Section 2, Chung-Shan Rd., Yuan-Lin, Chang-Hua Hsien, Taiwan

[21] Appl. No.: 5,037

[22] Filed: Jan. 15, 1993

[51] Int. Cl.[5] ..... E05F 3/04; E05F 3/14

[52] U.S. Cl. ..... 16/51; 16/62

[58] Field of Search ..... 16/51, 62, 49, 79, DIG. 39

[56] References Cited

U.S. PATENT DOCUMENTS

| | | | |
|---|---|---|---|
| 2,538,135 | 2/1952 | Woodruff | 16/51 |
| 3,675,270 | 7/1972 | Jentsch | 16/62 |
| 3,934,307 | 1/1976 | Lasier et al. | 16/62 |
| 4,590,639 | 5/1986 | Fritsche et al. | 16/DIG. 39 |
| 4,686,739 | 8/1987 | Fritsche et al. | 16/62 |

FOREIGN PATENT DOCUMENTS

| | | | |
|---|---|---|---|
| 292743 | 11/1988 | European Pat. Off. | 16/49 |

*Primary Examiner*—John Sipos
*Assistant Examiner*—Carmine Cuda
*Attorney, Agent, or Firm*—Browdy and Neimark

[57] ABSTRACT

An automatic door closing device comprises a base and an oil guiding loop. The base is provided in the direction of a longitudinal axis thereof with a canal and is further provided in the direction of a short axis thereof with a through hole. A sliding block and a spring are received slidably in an outer end portion of the canal. The oil guiding loop comprises a shaft tube having an inner end dimensioned to fit into the canal of the base and having an outer end provided thereon with a threaded portion and tension scale markings, a washer provided with a through hole and fitted into the outer end of the shaft tube, a sustaining rod having an outer end dimensioned to fit into the through hole of the washer and having an inner end provided thereon with an arresting flange dimensioned to fit into the outer end of the shaft tube, a rotating sleeve having an inner wall provided thereon with threads and having an inner diameter so dimensioned as to fit slidably over the threaded portion of the shaft tube, and a cap dimensioned to fit into the outer end of the shaft tube.

2 Claims, 3 Drawing Sheets

AUTOMATIC DOOR CLOSING DEVICE

BACKGROUND OF THE INVENTION

The present invention relates to a hydraulic door closing device.

In most offices and private homes, the doors in general and the entrance doors in particular are provided with an automatic door closing device fastened to the door frame and the door. Such a hydraulic device facilitates the slow and automatic closing of the door.

The conventional hydraulic door closing device is composed of a spring having a fixed tension, which must be overcome to cause the door to open. The spring of the conventional hydraulic door is generally devoid of a means capable of adjusting the tension of the spring at such time when the wind is gusty or when the weather is marked with a wild fluctuation of temperature. The climatic factors do play a role in affecting the viscosity of the oil in the automatic door closing device.

A hydraulic door closing device of the prior art is provided with a means capable of adjusting the tension of the spring of the hydraulic door closing device. Such an adjusting means comprises a threaded rod provided at the front end thereof with a guide member which is capable of urging one end of the spring and is capable of sliding in conjunction with the rotation of the guide member. The adjusting means further comprises an adjusting member, which is coupled with the rear end of the threaded rod for controlling the rotation of the guide member. The adjustment of the hydraulic door closing device is initiated by a hexagonal wrench, which is used to actuate the rotation of the threaded rod so as to trigger a forward movement or a backward movement of the guide member. As soon as the guide member has moved close to the rear end of the threaded rod, the spring is caused to compress. On the other hand, when the guide member has moved close to the front end of the threaded rod, the spring is caused to expand. When the spring is in a state of compression, a greater force is needed to open the door. On the contrary, when the spring is in a state of relaxation, the door can be opened with a little effort. However, the prior art hydraulic door closing device described above is by no means free from defects, which are expounded hereinafter.

The extent of the tension of the spring of the prior art hydraulic door closing device is adjusted by rotating the threaded rod of the adjusting means. In other words, the degree of the tension of the spring depends on the number of rotation that the threaded rod has been caused to turn. It often happens that a person, who is adjusting the tension of the spring, might easily mix up the rotation counts. In addition, the threaded rod is caused to rotate by a hexagonal wrench. As there is often a limited maneuvering space available between the hydraulic door closing device and the frame of the door to which the hydraulic door closing device is attached, the operation of rotating the threaded rod by a hexagonal wrench is often hampered.

The guide member of the adjusting means of the prior art hydraulic door closing device is often unable to move with precision in the direction of the axis of the threaded rod when the threaded rod rotates. Moreover, it happens at times that the guide member rotates without sliding forward or backward when the threaded rod rotates.

SUMMARY OF THE INVENTION

It is therefore the primary objective of the present invention to provide an automatic door closing device with the tension scale markings indicative of the precise extent of the compression of the spring of the device.

It is another objective of the present invention to provide an automatic door closing device with means enabling a person to make a quick adjustment of the degree or the tension of the spring of the device without using a hand tool.

The foregoing objectives, features and functions of the present invention will be better understood by studying the following detailed description of a preferred embodiment of the present invention in conjunction with the drawings provide herewith.

DETAILED DESCRIPTION OF THE PREFERRED EMBODIMENT

Figure 1:
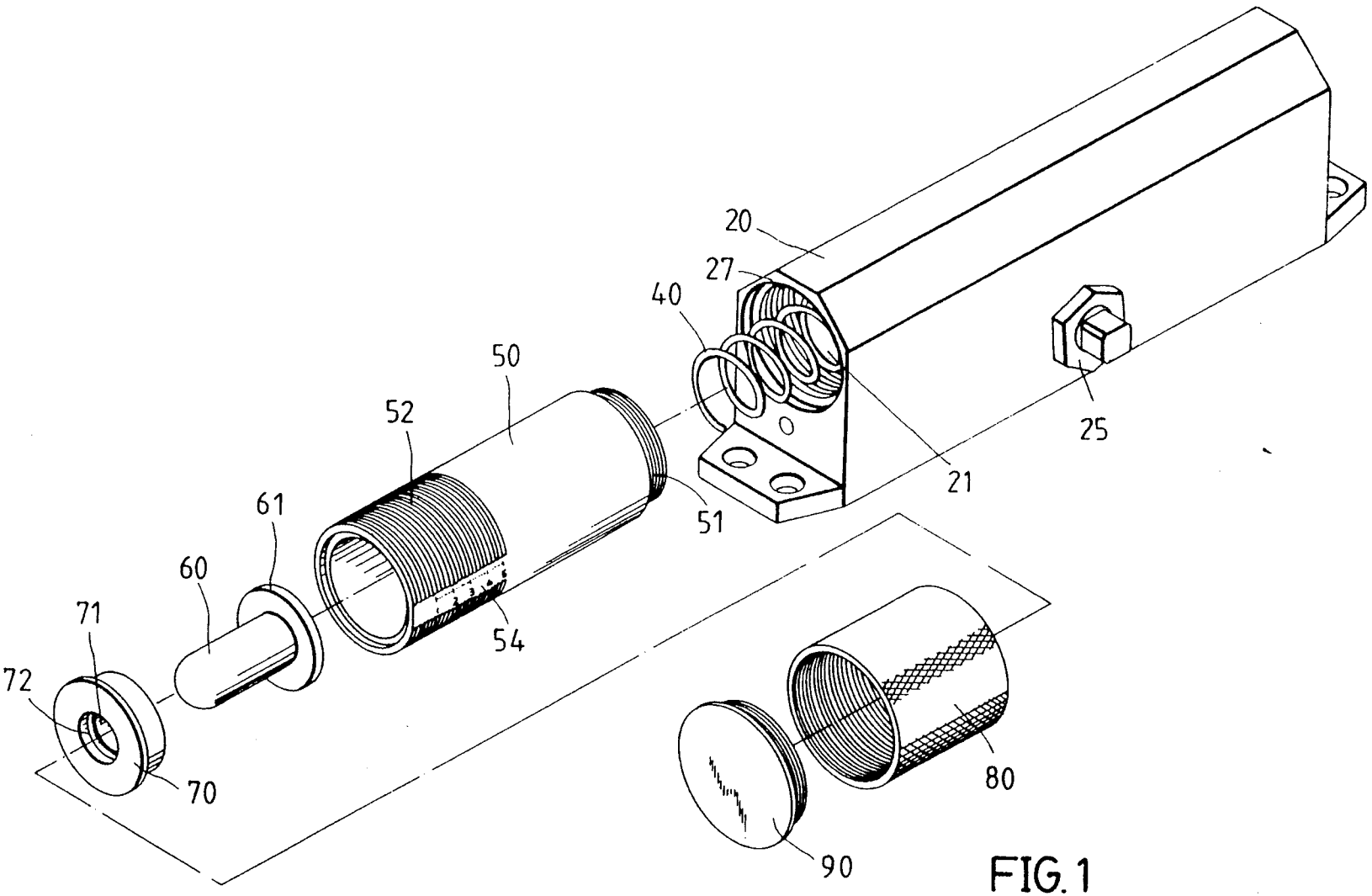
FIG. 1 shows a partial exploded view of an automatic door closing device of the present invention.
Figure 2:
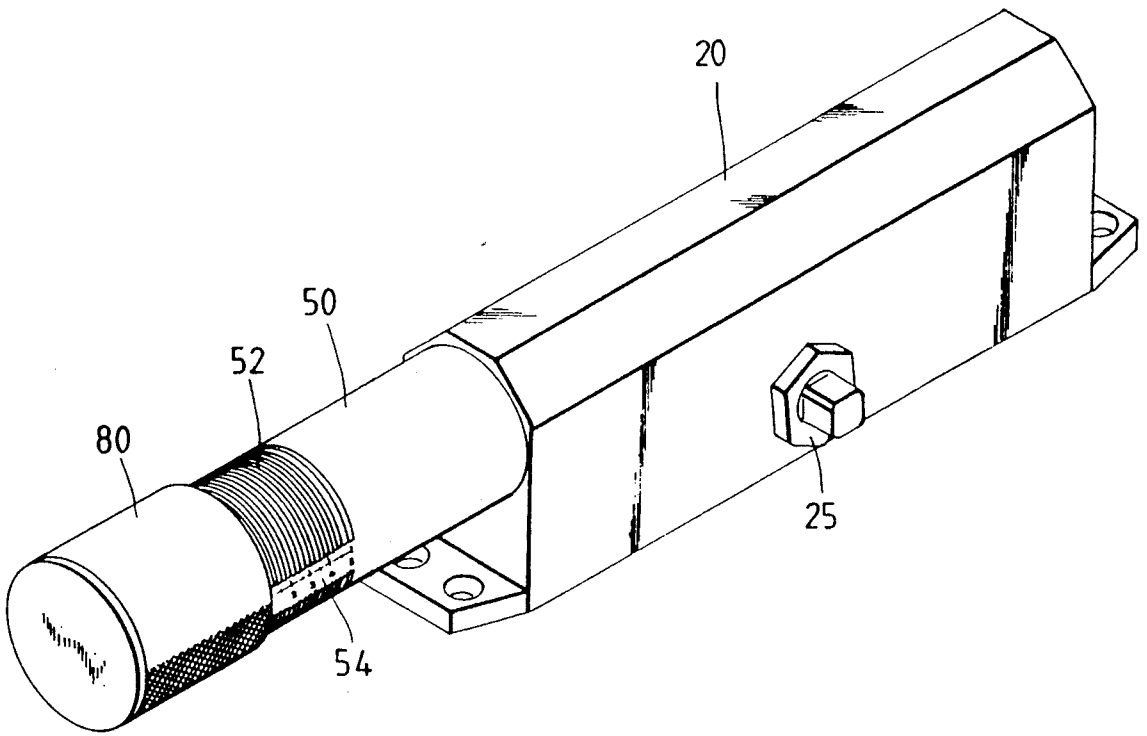
FIG. 2 shows a perspective view of the automatic door closing device in combination, according to the present invention.
Figure 3:
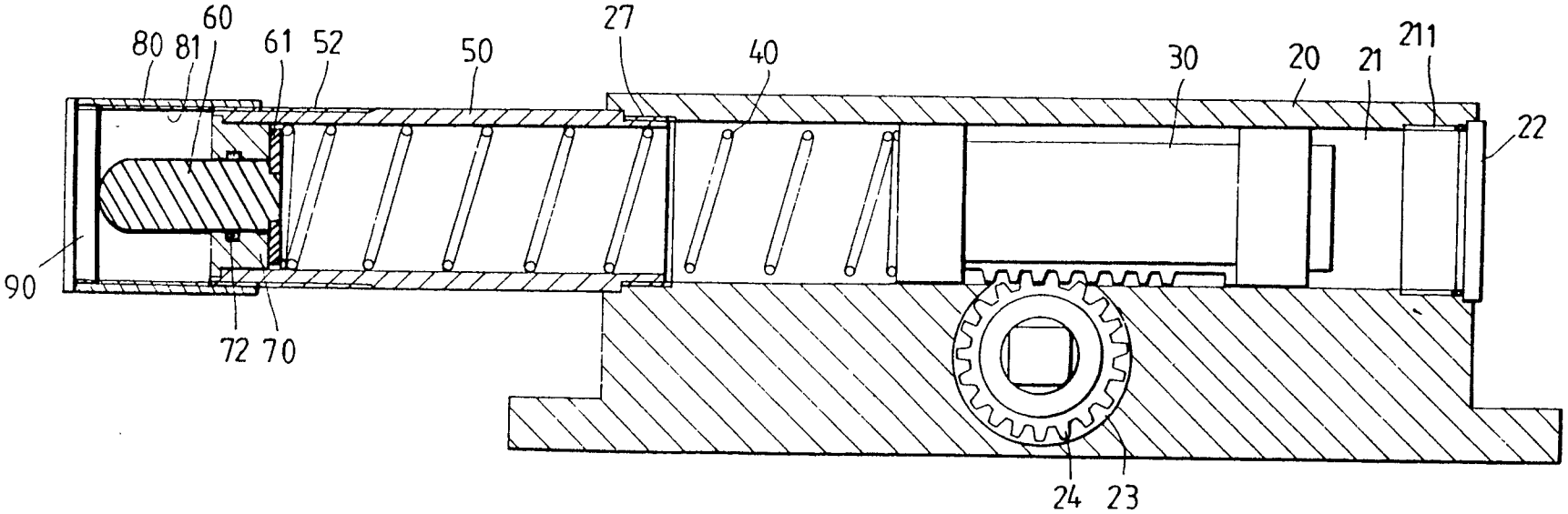
FIG. 3 shows a partial longitudinal sectional view of the automatic door closing device of the present invention.

Referring to FIGS. 2 and 3, an automatic door closing device of the present invention is shown to comprise a base 20 of a rectangular construction. The base 20 is provided therein a canal 21 running in the direction of the longitudinal axis of the base 20. The canal 20 is provided at a right end thereof with a female thread 211 for engaging a lock plate 22 which is used to seal off the right end of the canal 20, as shown in FIG. 3. Located along the short axis of the base 20 and under the canal 21 is a through hole 23 having two ends provided respectively with a female thread. A rotating rod 24 is received in the through hole 23 and is fastened securely by two lock rings 25 s as to seal off the through hole 23. The base 20 is further provided at a side thereof with three holes and a strip hole, which are in communication with one another to form a part of a hydraulic loop. sliding block 30 received in the canal 21 is capable of being actuated by the rotating rod 24 to slide linearly. A spring 40 is partially received in the canal 21 for affording the sliding block 30 a retrieving force. The left end of the canal 21 of the base 20 is provided with a female threaded portion 27 dimensioned to receive a male threaded portion 51 of a shaft tube 50 having another end provided thereon with a long threaded portion 52 having thereon scale markings 54 arranged in parallel to the axis of the shaft tube 50. A sustaining rod 60 received in the shaft tube 50 has one end provided with an arresting flange 61 for stopping the spring 40. The sustaining rod 60 has another end dimensioned to fit into a through hole 71 of a washer 70, which is provided with an annular groove 72 for receiving therein an oil seal ring to prevent an oil leakage. A rotating sleeve 80 has an inner wall provided thereon with a threaded portion 81 and is so dimensioned as to fit over the long threaded portion 52 of the shaft tube 50 such that the rotating sleeve 80 can be rotated to move forward or backward. A cap 90 is dimensioned to fit into the outer end of the rotating sleeve 80 to stop the outer end of the sustaining rod 60.

The adjustment of the tension cf the spring 40 of the present invention is done easily by turning the rotating sleeve 80 to move forward or backward until a desired tension scale marking 54 is in alignment with the inner end edge of the rotating sleeve 80.

The automatic door closing device of the present invention has advantages over the prior art device, which are elucidated hereinafter.

It is easy and convenient to adjust the tension of the spring of the automatic door closing device of the present invention by turning the rotating sleeve to move forward or backward without the help of a hand tool such as a hexagonal wrench, which is used in adjusting the tension of the automatic door closing device of the prior art.

In the process of adjusting the tension of the spring of the automatic door closing device of the present invention, the rotating sleeve works precisely every time without failure, in view of the fact that the spring is always urged by the sustaining rod. In the prior art device, the guide member often fails to move forward or backward with precision when the threaded rod rotates, thereby resulting in a failure of the tension adjustment of the spring.

The tension adjustment of the spring of the automatic door closing device of the present invention is further made easy by the tension scale markings provided visibly on the shaft tube.

In comparison with the prior art device which is made of an aluminium material, the material cost of the present invention is relatively lower in view of the fact that the shaft tube of the present invention is made of a non-aluminium material.

What is claimed is:

1. An automatic door closing device comprising:

a base provided in the direction of a longitudinal axis thereof with a canal and further provided in the direction of a short axis thereof with a through hole passing through said canal which has one end in which a sliding block is received in such a manner that said sliding block slides in the direction of an axis of said canal and in which a biasing means is received to provide said sliding block with a retrieving force, said through hole receiving threrein a rotating rod capable of being turned by an external force so as to actuate said sliding block to make a linear movement; and an oil guiding loop which is arranged between said base and a side of said sliding block and which further comprises:

a shaft tube having one end that is received in said canal and having another end that remains outside said canal and has a threaded portion of a length provided thereon with tension scale markings;

a washer provided with a through hole and fitted into said another end of said shaft tube;

a sustaining rod having one end dimensioned to fit into said through hole of said washer in such manner that said one end of said sustaining rod extends beyond said washer, said sustaining rod having another end provided thereon with an arresting flange dimensioned to fit slidably into said another end of shaft tube; and a rotating sleeve having an inner wall provided thereon with threads and having an inner diameter so dimensioned as to fit slidably over said threaded portion of said shaft tube, said rotating sleeve further having an outer end dimensioned to receive therein cap.

2. The automatic door closing device in accordance with claim 1 wherein said through hole of said washer is provided with an annular groove dimensioned to receive therein an oil seal ring.

* * * * *